US008056760B2

(12) United States Patent
Moran, Jr. et al.

(10) Patent No.: US 8,056,760 B2
(45) Date of Patent: Nov. 15, 2011

(54) CAP DISPENSING DEVICES USEFUL IN SYSTEM AND METHOD FOR DISPENSING PRESCRIPTIONS

(75) Inventors: Joseph C. Moran, Jr., Durham, NC (US); Demetris P. Young, Durham, NC (US); George Raymond Abrams, Jr., Cary, NC (US); Jeffrey P. Williams, Hillsborough, NC (US)

(73) Assignee: Parata Systems, LLC, Durham, NC (US)

( * ) Notice: Subject to any disclaimer, the term of this patent is extended or adjusted under 35 U.S.C. 154(b) by 139 days.

(21) Appl. No.: 11/738,664

(22) Filed: Apr. 23, 2007

(65) Prior Publication Data

US 2008/0173663 A1 Jul. 24, 2008

Related U.S. Application Data

(60) Provisional application No. 60/885,948, filed on Jan. 22, 2007.

(51) Int. Cl.
*B65H 7/00* (2006.01)

(52) U.S. Cl. ..... 221/14; 221/13; 221/22; 221/23; 221/203

(58) Field of Classification Search ..... 221/1–312 C; 700/231–244

See application file for complete search history.

(56) References Cited

U.S. PATENT DOCUMENTS

| | | | |
|---|---|---|---|
| 2,601,570 | A | 6/1952 | Suthers |
| 2,665,775 | A | 1/1954 | Smith |
| 2,708,996 | A | 5/1955 | Skillman |
| 2,748,914 | A | 6/1956 | Day |
| 2,865,532 | A | 12/1958 | Smith |
| 3,023,851 | A | 3/1962 | Stiller |
| 3,144,958 | A | 8/1964 | Gumpertz |
| 3,160,793 | A | 12/1964 | Colburn |
| 3,179,288 | A | 4/1965 | Davy |
| 3,185,851 | A | 5/1965 | D'Emilio |
| 3,196,276 | A | 7/1965 | Naab |
| 3,206,062 | A | 9/1965 | Rappaport |

(Continued)

FOREIGN PATENT DOCUMENTS

| | | |
|---|---|---|
| CA | 936 501 | 11/1973 |

(Continued)

OTHER PUBLICATIONS

International Search Report and Written Opinion for PCT/US2008/000031, dated May 15, 2008.

*Primary Examiner* — Michael K Collins
(74) *Attorney, Agent, or Firm* — Myers Bigel Sibley & Sajovec

(57) ABSTRACT

An apparatus for dispensing disk-shaped objects (such as caps for pharmaceutical vials) of two different sizes comprises: first and second dispensers, the first dispenser containing objects of a first size, and the second dispenser containing objects of a second size, each of the dispensers configured to dispense the objects one at a time through an outlet in a predetermined orientation; a first outlet channel having an inlet disposed adjacent the outlet of the first dispenser; a second outlet channel having an inlet disposed adjacent the outlet of the second dispenser; and a common chute fed by the first and second outlet channels. In this configuration, the apparatus can provide objects of two different sizes to a common location (such as a closure securing station).

11 Claims, 15 Drawing Sheets

U.S. PATENT DOCUMENTS

| | | | | | |
|---|---|---|---|---|---|
| 3,310,199 | A | | 3/1967 | Roberts | |
| 3,312,372 | A | | 4/1967 | Cooper, Jr. | |
| 3,410,450 | A | | 11/1968 | Fortenberry | |
| 3,417,542 | A | | 12/1968 | Merrill | |
| 3,436,736 | A | | 4/1969 | Platt | |
| 3,556,342 | A | | 1/1971 | Guarr | |
| 3,599,152 | A | | 8/1971 | Williams | |
| 3,610,469 | A | * | 10/1971 | Kuckens et al. | 221/258 |
| 3,653,176 | A | | 4/1972 | Gess | |
| 3,730,388 | A | | 5/1973 | Bender | |
| 3,732,544 | A | | 5/1973 | Obland | |
| 3,780,907 | A | | 12/1973 | Colburn | |
| 3,815,780 | A | | 6/1974 | Bauer | |
| 3,837,139 | A | | 9/1974 | Roseberg | |
| 3,885,702 | A | | 5/1975 | Joslin | |
| 3,917,045 | A | | 11/1975 | Williams | |
| 4,267,942 | A | | 5/1981 | Wick | |
| 4,434,602 | A | | 3/1984 | Culpepper | |
| 4,546,901 | A | | 10/1985 | Buttarazzi | |
| 4,573,606 | A | | 3/1986 | Lewis | |
| 4,655,026 | A | | 4/1987 | Wigoda | |
| 4,664,289 | A | | 5/1987 | Shimizu | |
| 4,674,259 | A | | 6/1987 | Hills | |
| 4,674,651 | A | | 6/1987 | Scidmore | |
| 4,693,057 | A | | 9/1987 | Rittinger | |
| 4,695,954 | A | | 9/1987 | Rose et al. | |
| 4,741,428 | A | | 5/1988 | Taniguchi et al. | |
| 4,766,542 | A | | 8/1988 | Pilarczyk | |
| 4,767,023 | A | | 8/1988 | Hackmann | |
| 4,801,044 | A | | 1/1989 | Kubota et al. | |
| 4,805,377 | A | | 2/1989 | Carter | |
| 4,869,392 | A | | 9/1989 | Moulding, Jr. | |
| 4,918,604 | A | | 4/1990 | Baum | |
| 4,949,526 | A | * | 8/1990 | Brogna et al. | 53/306 |
| 4,971,513 | A | | 11/1990 | Bergerioux | |
| 4,980,292 | A | | 12/1990 | Elbert | |
| 4,984,709 | A | | 1/1991 | Weinstein | |
| 5,018,644 | A | | 5/1991 | Hackmann | |
| 5,047,948 | A | | 9/1991 | Turner | |
| 5,316,517 | A | * | 5/1994 | Chiba et al. | 453/57 |
| 6,006,946 | A | * | 12/1999 | Williams et al. | 221/9 |
| RE37,829 | E | | 9/2002 | Charhut | |
| 6,631,826 | B2 | | 10/2003 | Pollard et al. | |
| 6,971,541 | B2 | | 12/2005 | Williams et al. | |
| 7,228,198 | B2 | * | 6/2007 | Vollm et al. | 700/235 |
| 7,344,049 | B2 | * | 3/2008 | Daniels et al. | 221/92 |

FOREIGN PATENT DOCUMENTS

| | | | |
|---|---|---|---|
| DE | 1481166 | | 8/1970 |
| GB | 1 168 758 | | 10/1969 |
| GB | 1 411 951 | | 10/1975 |
| JP | 51-000792 | B | 1/1976 |
| JP | 52-047400 | | 4/1977 |
| JP | 61-104904 | A | 5/1986 |
| JP | 63-208410 | A | 8/1988 |
| JP | 64-028102 | A | 1/1989 |
| JP | 1-288265 | A | 11/1989 |
| JP | 2-028417 | A | 1/1990 |

* cited by examiner

CAP DISPENSING DEVICES USEFUL IN SYSTEM AND METHOD FOR DISPENSING PRESCRIPTIONS

RELATED APPLICATION

This application claims priority from U.S. Provisional Patent Application No. 60/885,948, filed Jan. 22, 2007 and entitled Cap Dispensing Devices Useful in System and Method for Dispensing Prescriptions, the disclosure of which is hereby incorporated herein by reference in its entirety.

FIELD OF THE INVENTION

The present invention is directed generally to the dispensing of prescriptions of pharmaceuticals, and more specifically is directed to the automated dispensing of pharmaceuticals.

BACKGROUND OF THE INVENTION

Pharmacy generally began with the compounding of medicines, which entailed the actual mixing and preparing of medications. Heretofore, pharmacy has been, to a great extent, a profession of dispensing, that is, the pouring, counting, and labeling of a prescription, and subsequently transferring the dispensed medication to the patient. Because of the repetitiveness of many of the pharmacists tasks, automation of these tasks has been desirable.

Some attempts have been made to automate the pharmacy environment. Different exemplary approaches are shown in U.S. Pat. No. 5,337,919 to Spaulding et al. and U.S. Pat. Nos. 6,006,946; 6,036,812 and 6,176,392 to Williams et al. These systems utilize robotic arms to grasp a container, carry it to one of a number of bins containing tablets (from which a designated number of tablets are dispensed), carry it to a printer, where a prescription label is applied, and release the filled container in a desired location. Tablets are counted and dispensed with any number of counting devices. Drawbacks to these systems typically include the relatively low speed at which prescriptions are filled and the absence in these systems of securing a closure (i.e., a lid) on the container after it is filled.

One additional automated system for dispensing pharmaceuticals is described in some detail in U.S. Pat. No. 6,971,541 to Williams et al. This system has the capacity to select an appropriate vial, label the vial, fill the vial with a desired quantity of a selected pharmaceutical tablet, apply a cap to the filled vial, and convey the labeled, filled, capped vial to an offloading station for retrieval.

Although this particular system can provide automated pharmaceutical dispensing, certain of the operations may be improved. For example, the Williams et al. system employs two different cap dispensers, each of which dispenses a cap of a different size. In this system, the station that applies the dispensed caps to filled vials has two different stages or bays for capping, one for each size cap. It may be desirable to provide a capping station with a single capping stage. In addition, it may be desirable to provide an apparatus that can convey caps of different sizes to the single capping stage.

SUMMARY OF THE INVENTION

As a first aspect, embodiments of the present invention are directed to an apparatus for dispensing disk-shaped objects (such as caps for pharmaceutical vials). The apparatus comprises: first and second dispensers, the first dispenser containing objects of a first size, and the second dispenser containing objects of a second size, each of the dispensers configured to dispense the objects one at a time through an outlet in a predetermined orientation; a first outlet channel having an inlet disposed adjacent the outlet of the first dispenser; a second outlet channel having an inlet disposed adjacent the outlet of the second dispenser; and a common chute fed by the first and second outlet channels. In this configuration, the apparatus can provide objects of two different sizes to a common location (such as a closure securing station).

As a second aspect, embodiments of the present invention are directed to a dispenser for dispensing disk-shaped objects. The dispenser is configured to dispense the objects one at a time through an outlet in a predetermined orientation. The dispenser includes a pre-staging station adjacent the outlet. The pre-staging station is configured to dispense an object to a desired location and to house a next object for subsequent dispensing. In this configuration, the dispensing of the object (such as a cap for a pharmaceutical vial) to a subsequent station can be facilitated and rendered more predictable.

As a third aspect, embodiments of the present invention are directed to a method of dispensing caps for vials filled with pharmaceuticals. The method comprises the steps of: providing a cap dispenser with a pre-staging station, the cap dispenser housing a plurality of caps; positioning a first cap at a first location on the pre-staging station; and dispensing a second cap from the dispenser onto the pre-staging station and to the first location. The dispensing step induces the first cap to move from the first location on the pre-staging station to a second location at a closure securing station.

DETAILED DESCRIPTION OF EMBODIMENTS OF THE INVENTION

Figure 1:
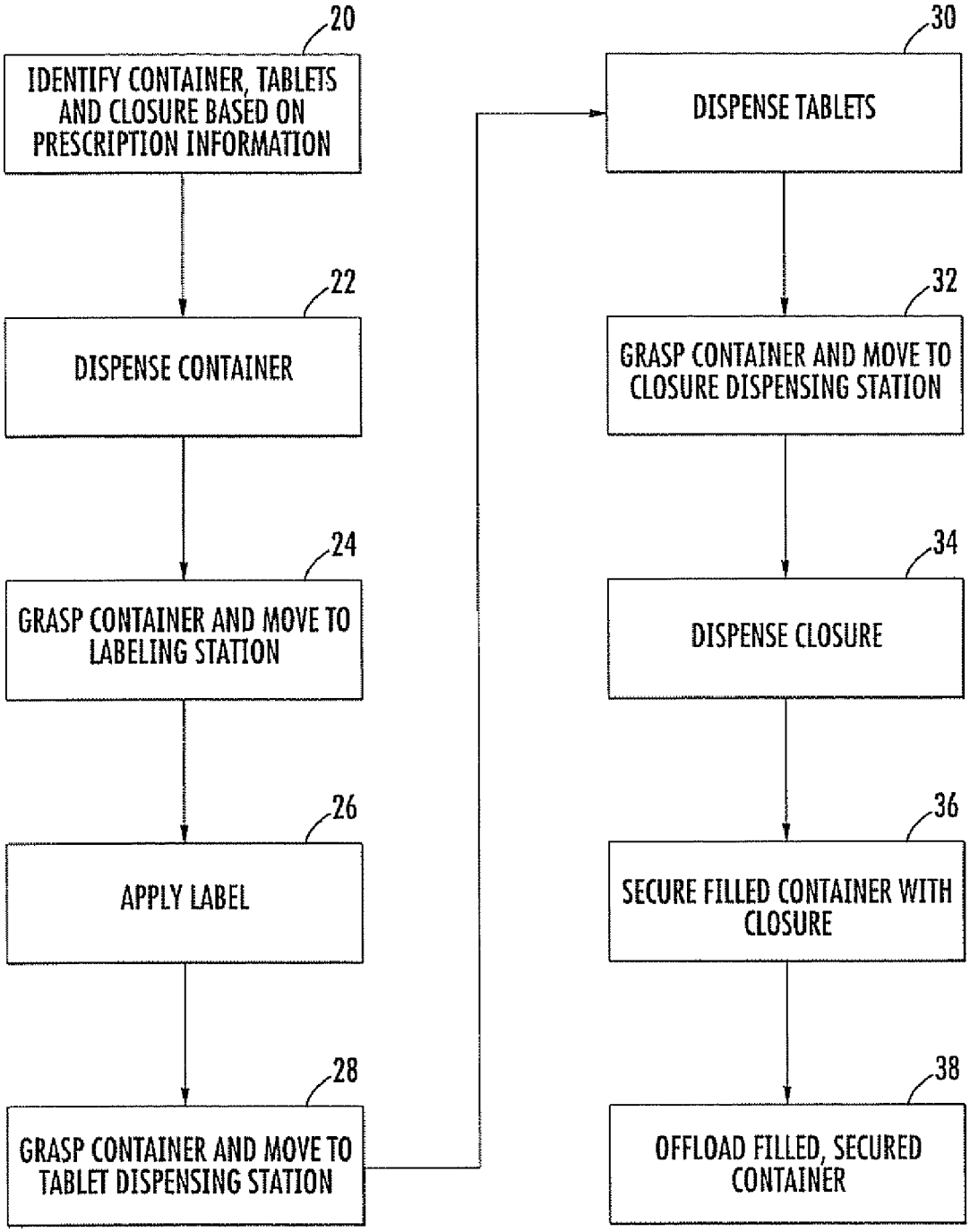
FIG. 1 is a flow chart illustrating an embodiment of a method according to the present invention.

The present invention will now be described more fully hereinafter, in which preferred embodiments of the invention are shown. This invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout. Thicknesses and dimensions of some components may be exaggerated for clarity.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

In addition, spatially relative terms, such as "under", "below", "lower", "lower", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constructions may not be described in detail for brevity and/or clarity.

As described above, the invention relates generally to a system and process for dispensing pharmaceuticals. An exemplary process is described generally with reference to FIG. 1. The process begins with the identification of the proper container, tablets or capsules and closure to be dispensed based on a patient's prescription information (Box 20). A container of the proper size is dispensed at a container dispensing station (Box 22), then grasped and moved to a labeling station (Box 24). The labeling station applies a label (Box 26), after which the container is transferred to a transport system and moved to a tablet dispensing station (Box 28), from which the designated tablets are dispensed in the designated amount into the container (Box 30). The filled container is then grasped again and moved to a closure dispensing station (Box 32), where a closure of the proper size has been dispensed (Box 34). The filled container is secured with a closure (Box 36), then transported to an offload station and offloaded (Box 38).

Figure 2:
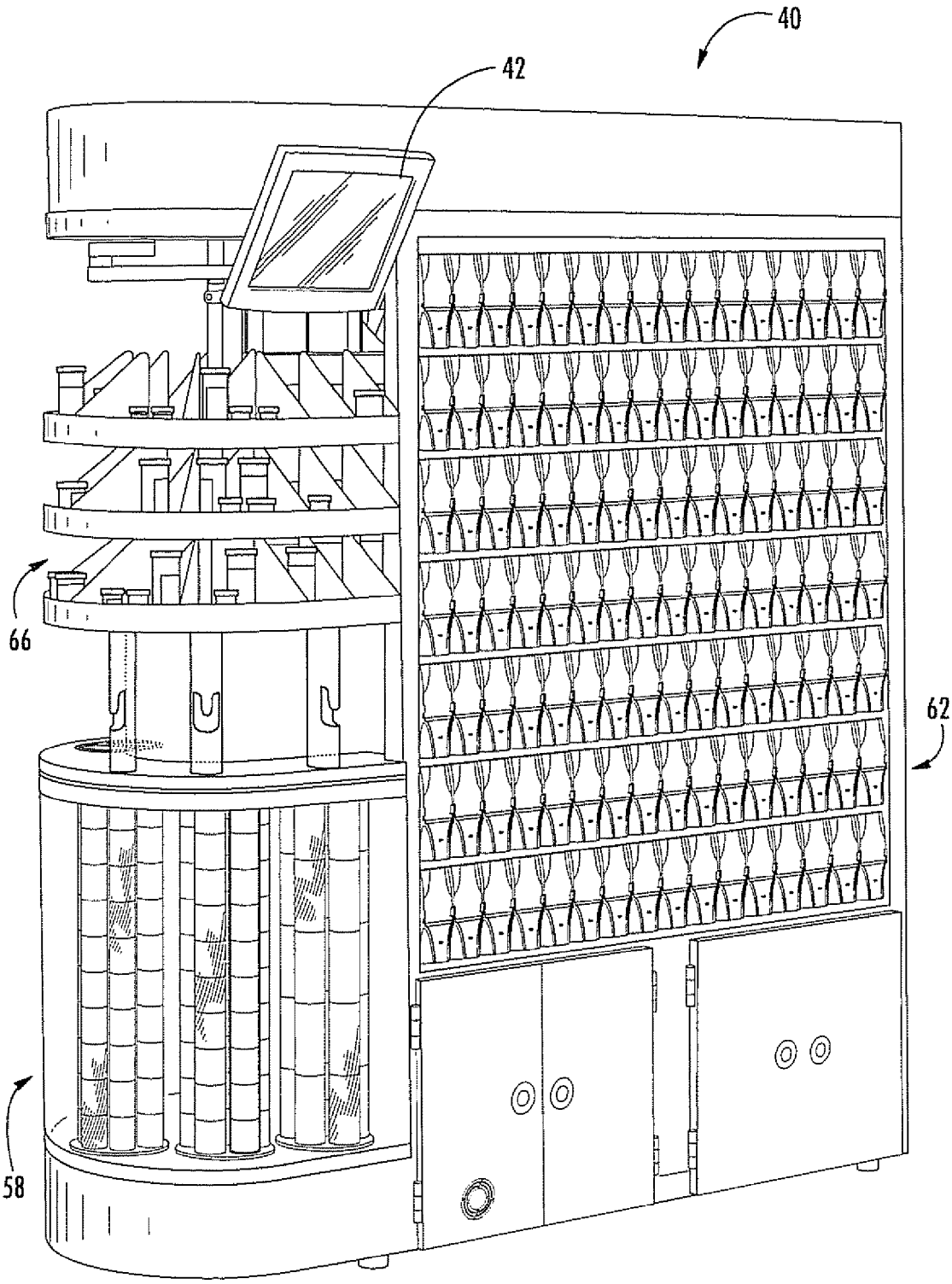
FIG. 2 is a perspective view of a pharmaceutical tablet dispensing system according to the present invention.
Figure 3:
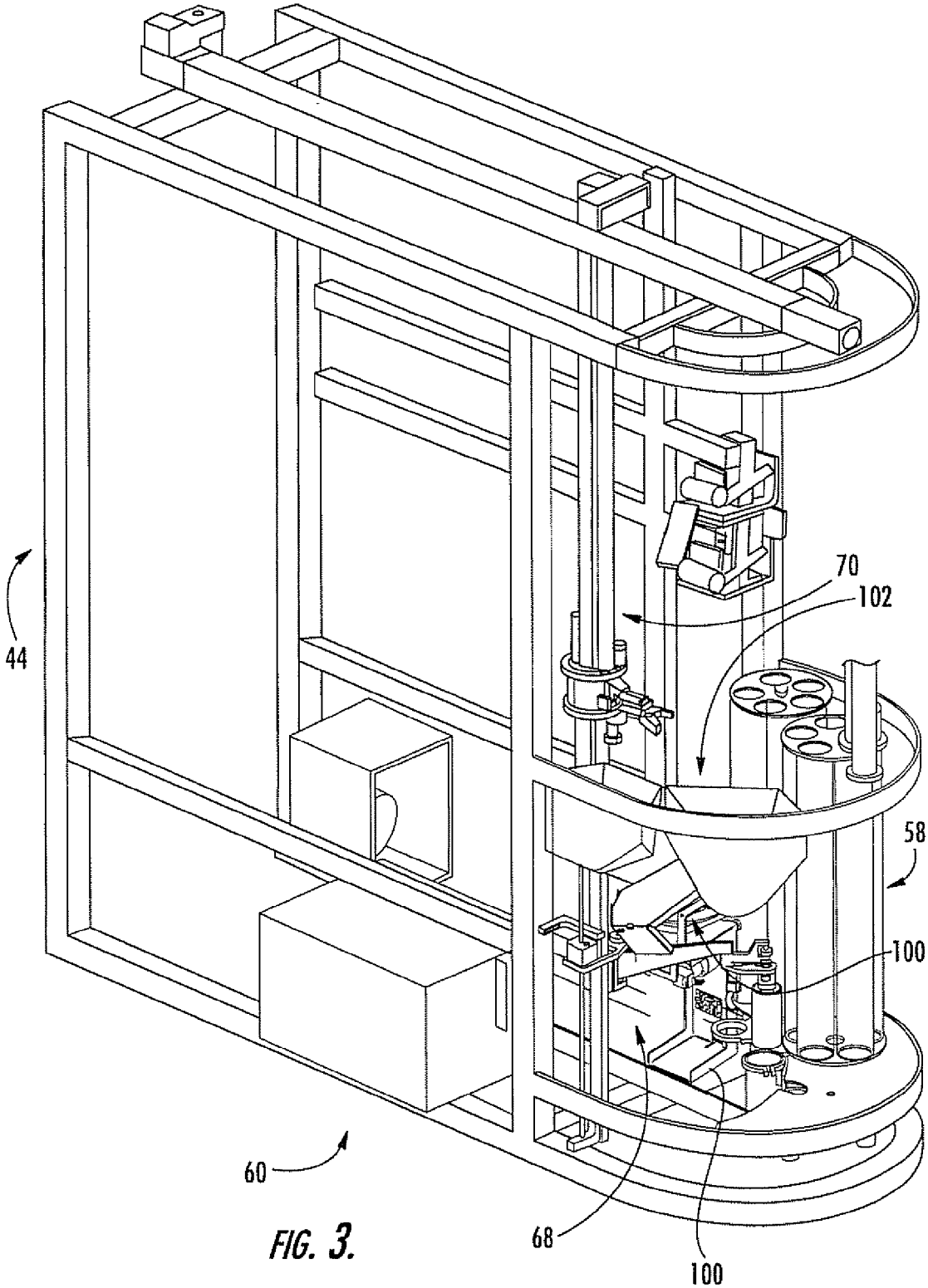
FIG. 3 is a cutaway perspective view of the system of FIG. 2 illustrating the support frame, the container dispensing station, the labeling carrier, the dispensing carrier, and the closure dispensing station.

A system that can carry out this process is illustrated in FIGS. 2 and 3 and designated broadly therein at 40. The system 40 includes a support frame 44 for the mounting of its various components. The system 40 generally includes as operative stations a controller 42, a container dispensing station 58, a labeling station 60, a tablet dispensing station 62, a closure securing station 100, a closure dispensing station 102, and an offloading station 66. In the illustrated embodiment, containers, tablets and closures are moved between these stations with two different conveying devices: a labeling carrier 68 and a dispensing carrier 70; however, in some embodiments only a single carrier may be employed, or one or more additional carriers may be employed. With the exception of the closure dispensing station 102, which is described in detail below, and the closure securing station 100 is described in co-pending and co-assigned U.S. Patent Application Ser. No. 60/885,269, filed Jan. 17, 2007, entitled DEVICES USEFUL IN SYSTEM AND METHOD FOR DISPENSING PRESCRIPTIONS, the disclosure of which is hereby incorporated herein in is entirety, each of the other operative stations and the conveying devices is described in detail in U.S. Pat. No. 6,971,541 to Williams et al., the disclosure of which is hereby incorporated herein in its entirety.

Figure 4:
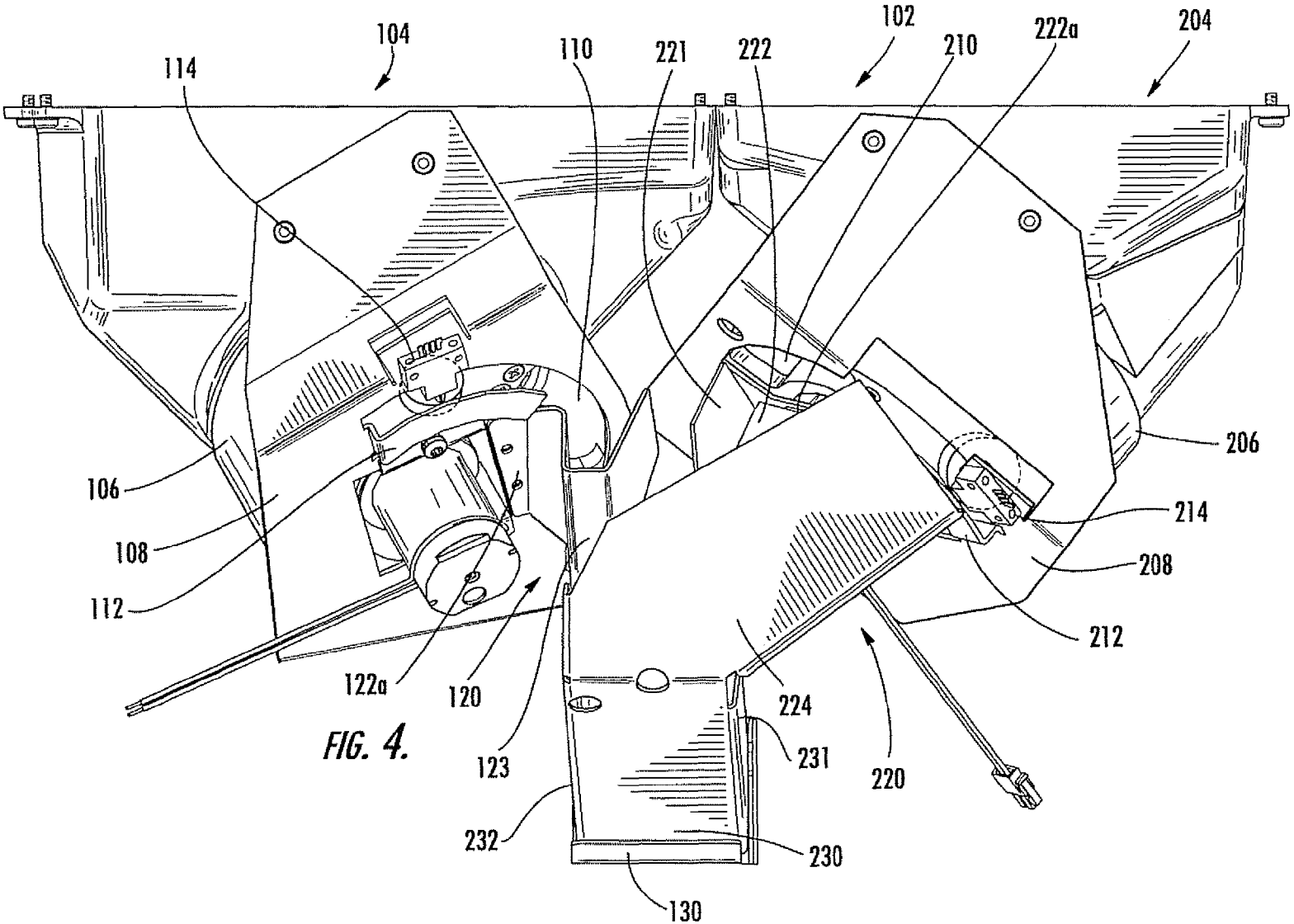
FIG. 4 is a front view of the closure dispensers and outlet channels of the system of FIG. 2.

Referring now to FIG. 4, the closure dispensing station 102 is illustrated in some detail therein. The closure dispensing station 102 includes two closure dispensers 104, 204, each of which has a respective bin 106, 206. The dispensers 104, 204 dispense caps via a rotating drum that agitates, singulates and orients the caps in a preferred orientation (in this instance, the open end of the cap faces radially inwardly (i.e., toward the axis about which the drum rotates). A detailed description of the configuration and operation of the dispensers 104, 204 is set forth in the aforementioned U.S. Pat. No. 6,971,541 to Williams et al. Typically, the dispensers 104, 204 contain caps of different sizes; i.e., the dispenser 104 contains caps of a first size and the dispenser 204 contains caps of a second, different size. The dispensers 104, 204 may also contain caps of the same size in order to increase the capacity of the system 40 for handling a single cap size.

A respective bottom plate 108, 208 is mounted to the underside of each dispenser 104, 204. Each bottom plate 108, 208 has an arcuate outlet slot 110, 210 that extends for approximately 90 degrees about the rotational axis of the dispenser drum. A pre-staging platform 112, 212 is positioned below a portion of each of the outlet slots 110, 210. Also, in this embodiment, the drums of the dispensers 104, 204 rotate in opposite directions, with the result that their outlet slots 110, 210 are relatively close to each other, which can reduce the lengths of outlet channels 120, 220 described below. However, the drums may rotate in the same direction in other embodiments.

The closure dispensing station 102 also includes two outlet channels 120, 220, the inlet of each of which is fed by a respective closure dispenser 104, 204, and a common lower chute 130 that is fed by both of the outlet channels 120, 220. These structures are described in detail below.

Turning now to FIG. 5, the outlet channel 120 includes an upright side wall 122, a floor 123 that merges with the upright side wall 122, and a sloped side wall 124 that merges with the floor 123 opposite the upright side wall 122. The upper end of the upright side wall 122 includes a flange **122*a* that is mounted to the underside of the bottom plate 108, with the result that the floor 123 resides below the outlet slot 110 of the dispenser 104. The upper end of the sloped side wall 124 diverges from the upper end of the upright side wall 122, such that it forms an angle of between about 10 and 40 degrees with the floor 123. The front edge 125 of the sloped side wall 124 is angled, such that the upper edge of the sloped side wall 124 is shorter than the lower edge that merges with the floor 123**.

The floor 123 slopes downwardly from its upper end, which resides under the outlet slot 110, to its lower end, which merges with an upper chute 126. An orienting bar 127 extends across the lower end of the floor 123 at an obtuse angle to the upper chute 126, with one end of the bar 127 being positioned adjacent the front edge of the upright side wall 122, and the other end of the bar 127 being positioned in front of the front edge of the sloped side wall 124. The lower end of the upper chute 126 merges with and empties into the lower chute 130, the structure of which is described in greater detail below.

Figure 6A:
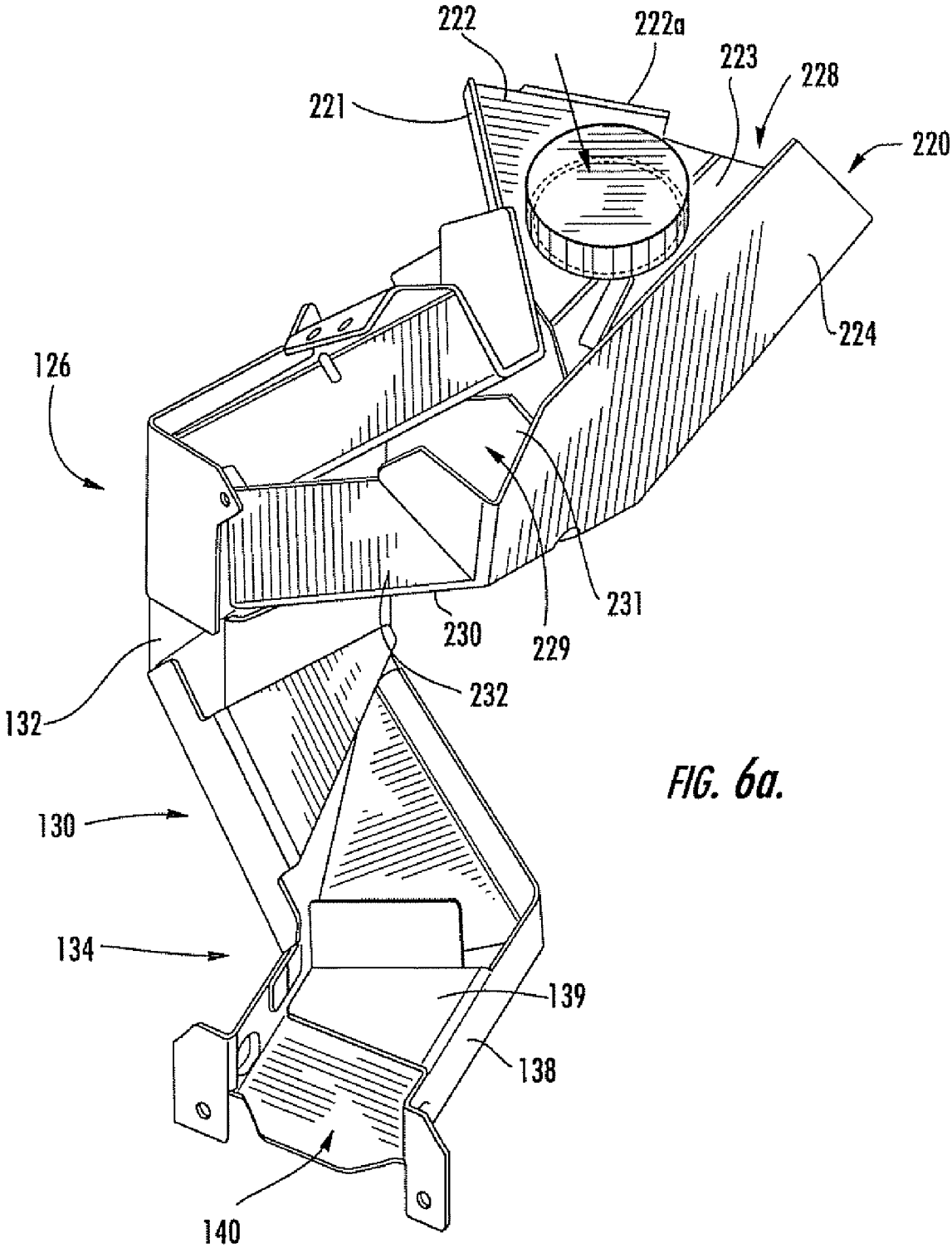
FIGS. 6*a*-6*d* are rear views of the outlet channels of the closure dispenser of the system of FIG. 2 showing a cap traveling through the other of the outlet channels.

Turning now to FIG. 6*a*, the outlet channel 220 includes a bumper 221 that is positioned below and at the end of the outlet slot 210 of the closure dispenser 204. A floor 222 merges with one edge of the bumper 221; a flange 222*a* merges with an upper edge of the floor 222 and is mounted to the underside of the bottom plate 208. A trough 228 is formed by a steep slide panel 223, which merges at one edge and extends downwardly from a lower edge of the floor 222, a floor 225 that merges with the steep slide panel 223, and a shallow slide panel 224, which merges with the other edge of the floor 225. The trough 228 slopes downwardly to a position below the outlet channel 120 to empty into an open channel 229 having a floor 230. The floor 230 is bounded by side walls 231, 232 and extends beneath the outlet channel 120 to the upper end of the lower chute 130, with the outlet portion of the channel 229 being positioned below the lower end of the upper chute 126.

Referring still to FIG. 6*a*, the lower chute 130 includes a vertical run 132 bounded by panels on all sides that is fed by both the upper chute 126 and the channel 229. The vertical run 132 empties into a three-section sloping run 134, with each subsequent section becoming shallower and changing direction. The lowest section 138 of the sloping run 134, which empties into a closure securing station 100 via an outlet 140, includes a guard 139 to encourage reliable travel of caps.

As described above, the closure dispensing station 100 requires that the cap be delivered "face down", i.e., in an orientation in which the open end of the cap faces downwardly. Thus, the closure dispensing station 102 should be configured so that caps being dispensed from either closure dispenser 104, 204 (which may, in some embodiments, be caps of different sizes) are delivered in this orientation.

Figure 5A:
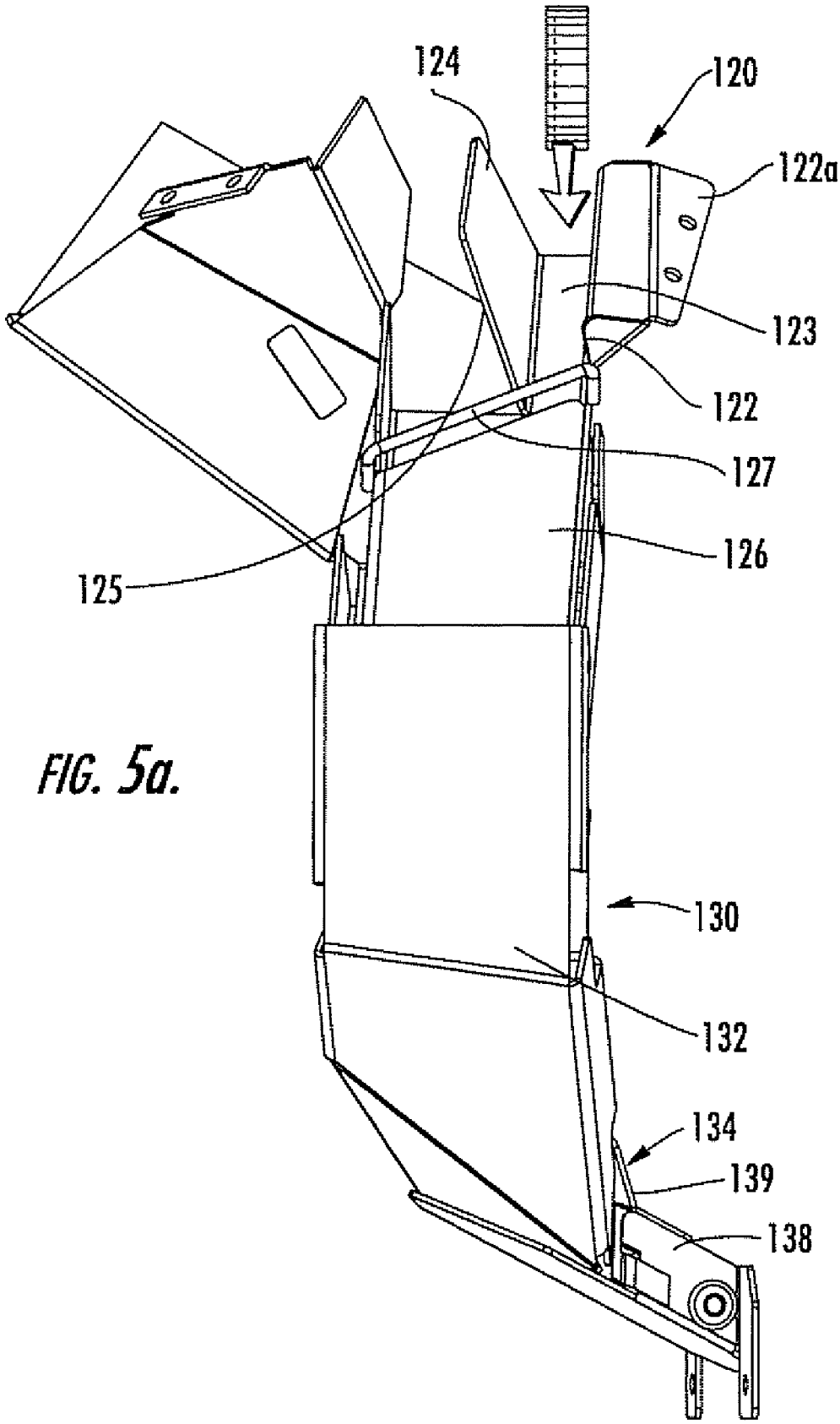
FIGS. 5*a*-5*d* are side views of the outlet channels of the closure dispenser of the system of FIG. 2 showing a cap traveling through one of the outlet channels.
Figure 5B:
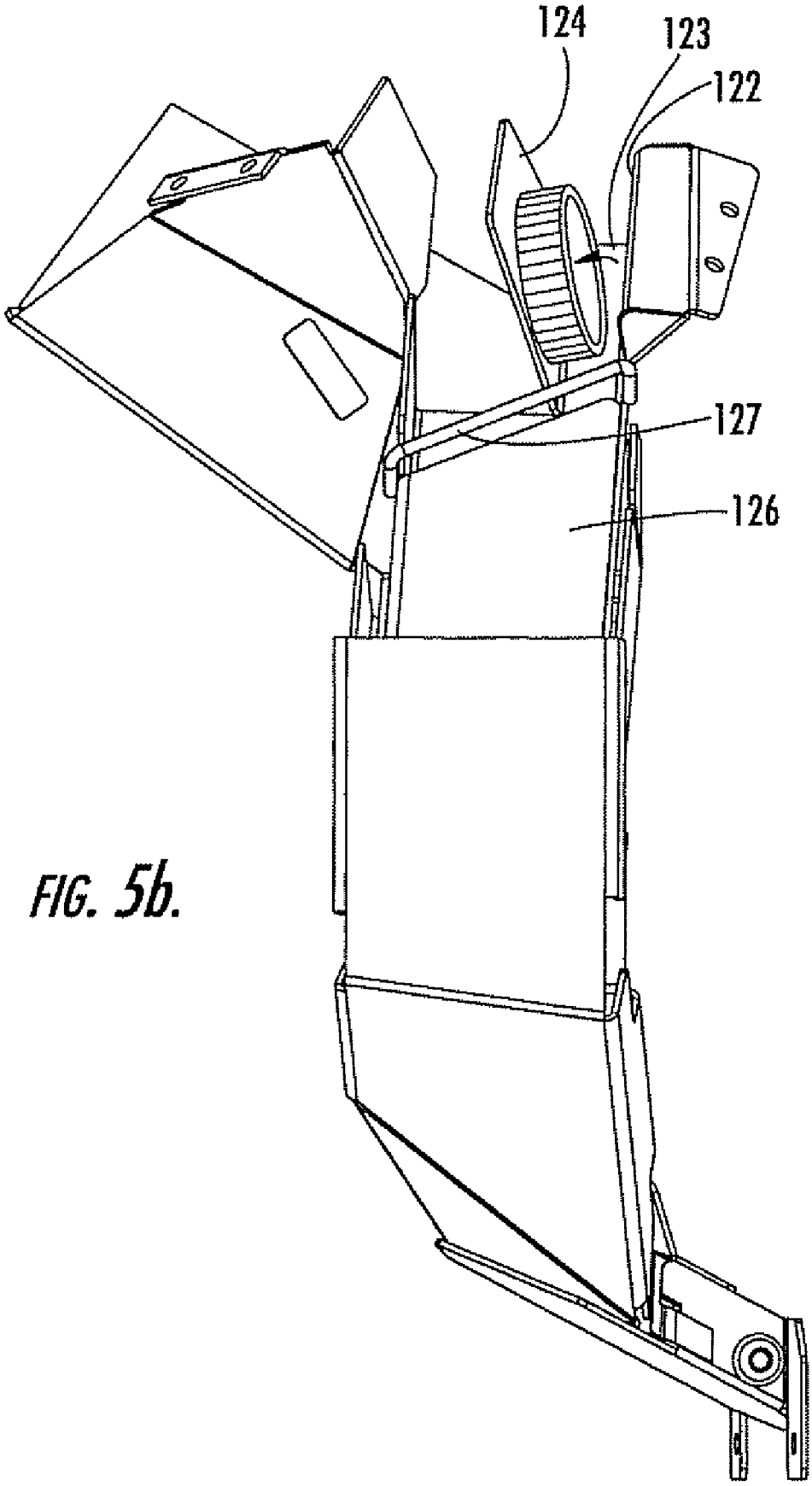
Figure 5C:
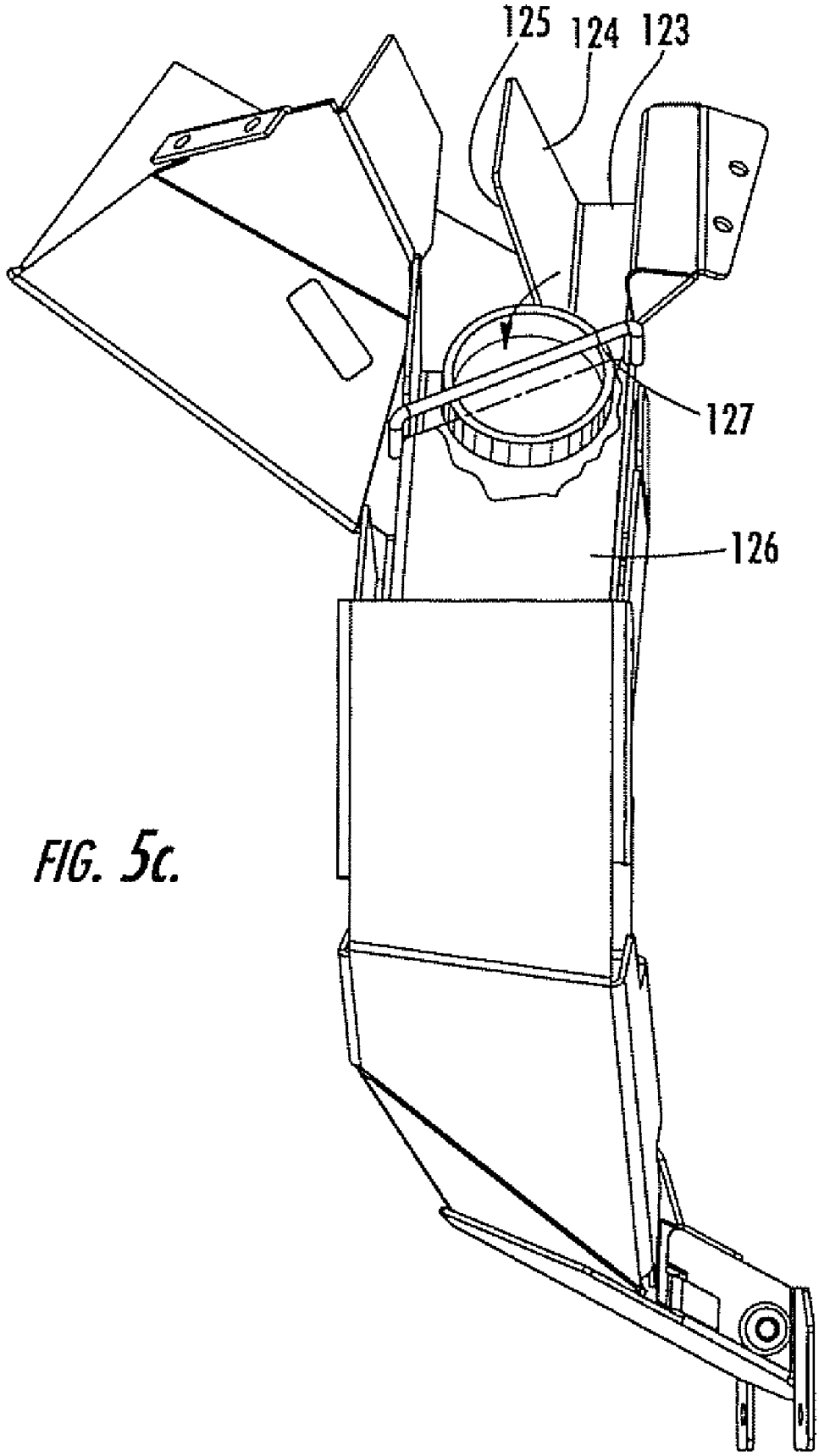

Looking first at caps being dispensed from the closure dispenser 104, and turning to FIG. 4, as a cap exits the closure dispenser 104 through the outlet slot 110, the open end of the cap is facing the drum of the closure dispenser 104. Thus, when the cap drops through the outlet slot 110 into the outlet channel 120, the open end of the cap faces the upright side wall 122 (FIG. 5*a*). Because the sloping side wall 124 is angled away from the upright side wall 122, the cap tends to tip, such that its upper edge contacts the sloping side wall 124 (FIG. 5*b*). In this orientation, the open end of the cap faces slightly upward. Once in the outlet channel 120, the cap slides down the floor 123. As the cap reaches the end of the sloping wall 124, the angled front edge 125 of the sloping side wall 124 urges the cap to tip further until it reaches an orientation in which the open end of the cap faces upwardly (FIG. 5*c*). If this orientation has not been reached by the time the cap reaches the orienting bar 127, contact with the orienting bar 127 by a partially tipped cap urges the cap into a "face-up" orientation as it enters the upper chute 126.

Figure 5D:
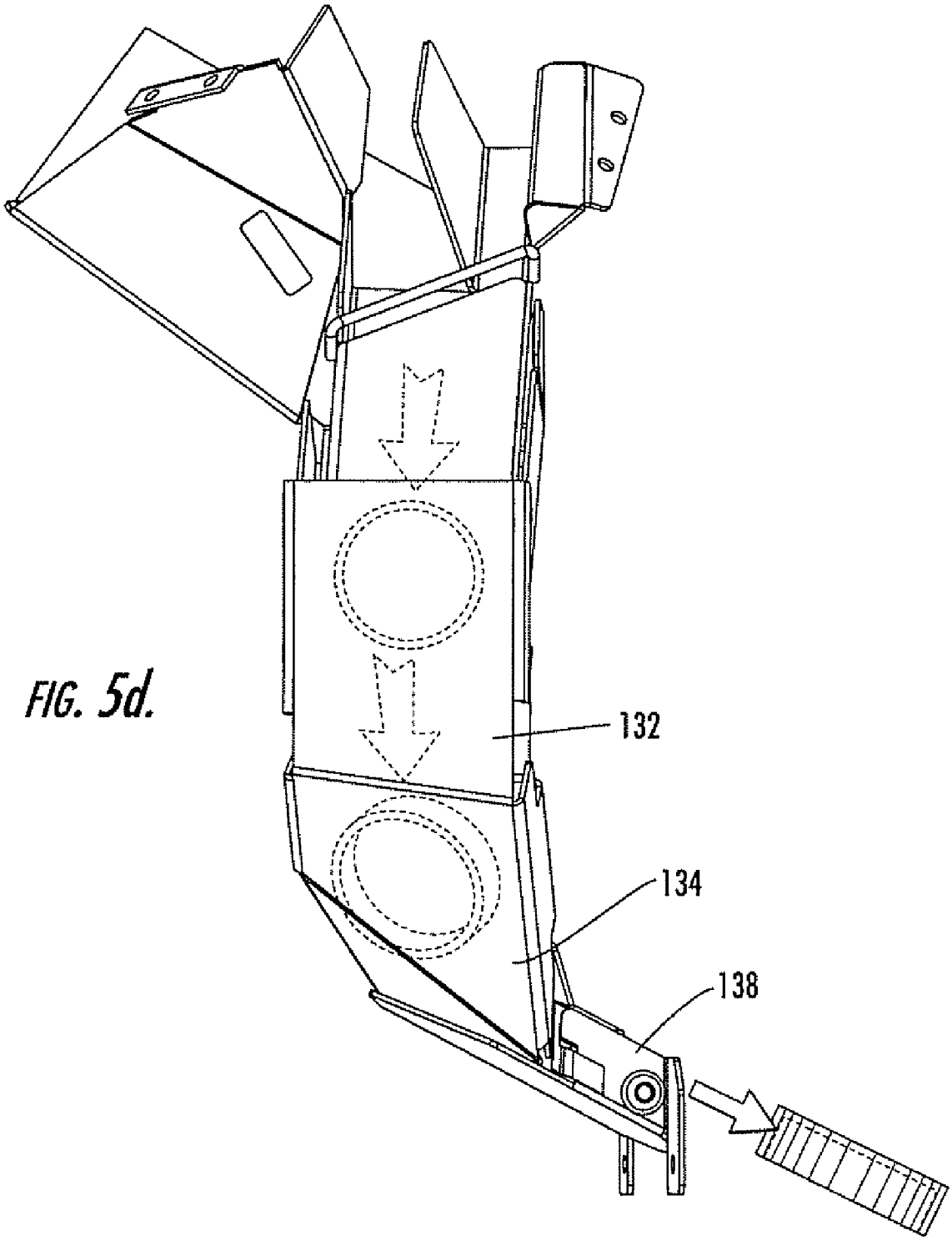

Once the cap exits the upper chute 126, it drops down the vertical run 132 of the lower chute 130, then slides onto the sloping run 134 in a "face-down" condition (FIG. 5*d*). This condition is maintained as the cap slides through the sloping run 134 and out of the outlet 140 into the closure securing station 100 (see FIGS. 6*e*-6*g*). The guard 139 is positioned to encourage caps to maintain the "face-down" condition as they traverse the sloping run 134.

Figure 6B:
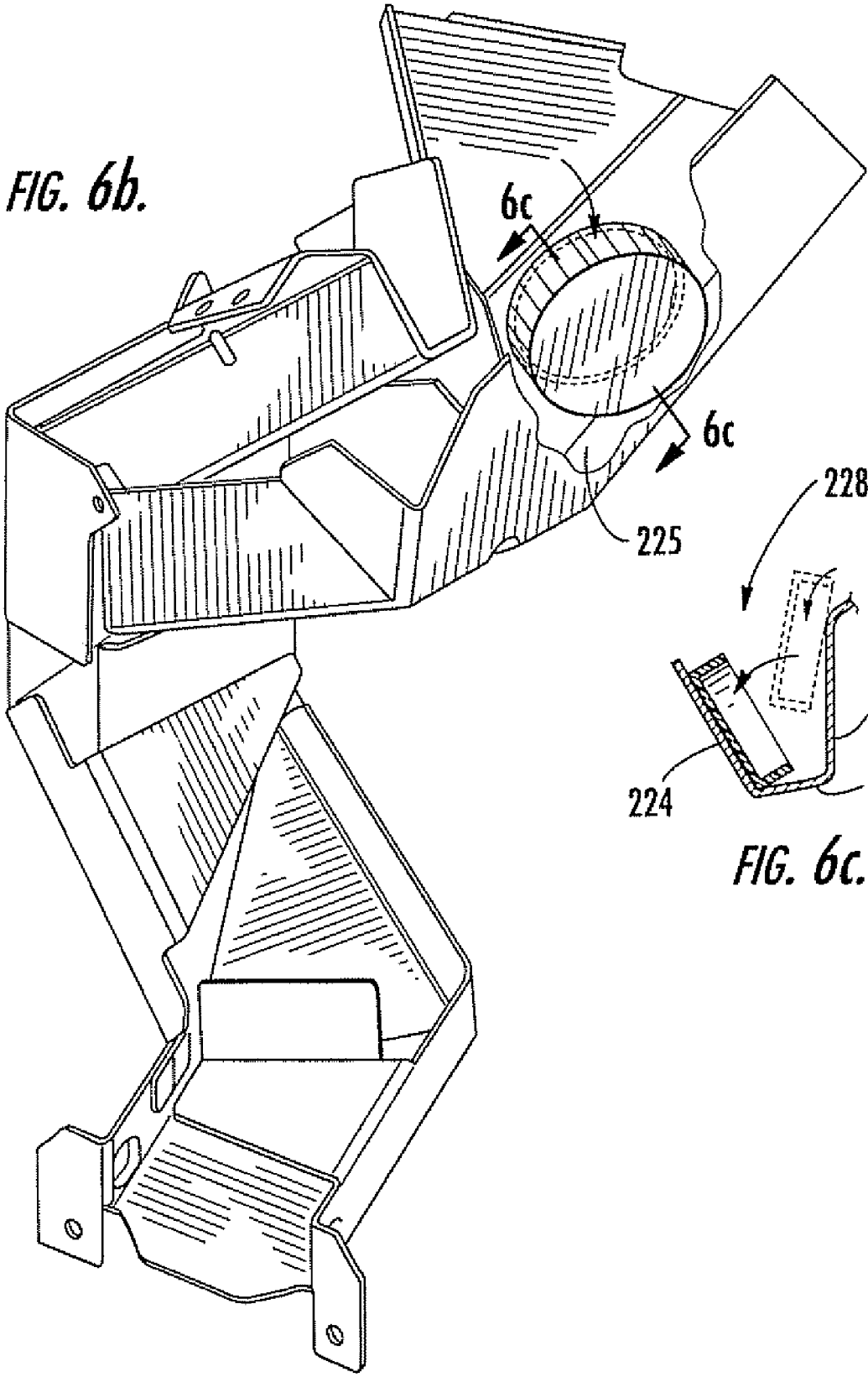
Figure 6C:
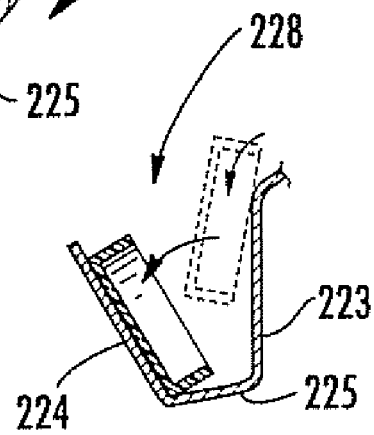
Figure 6D:
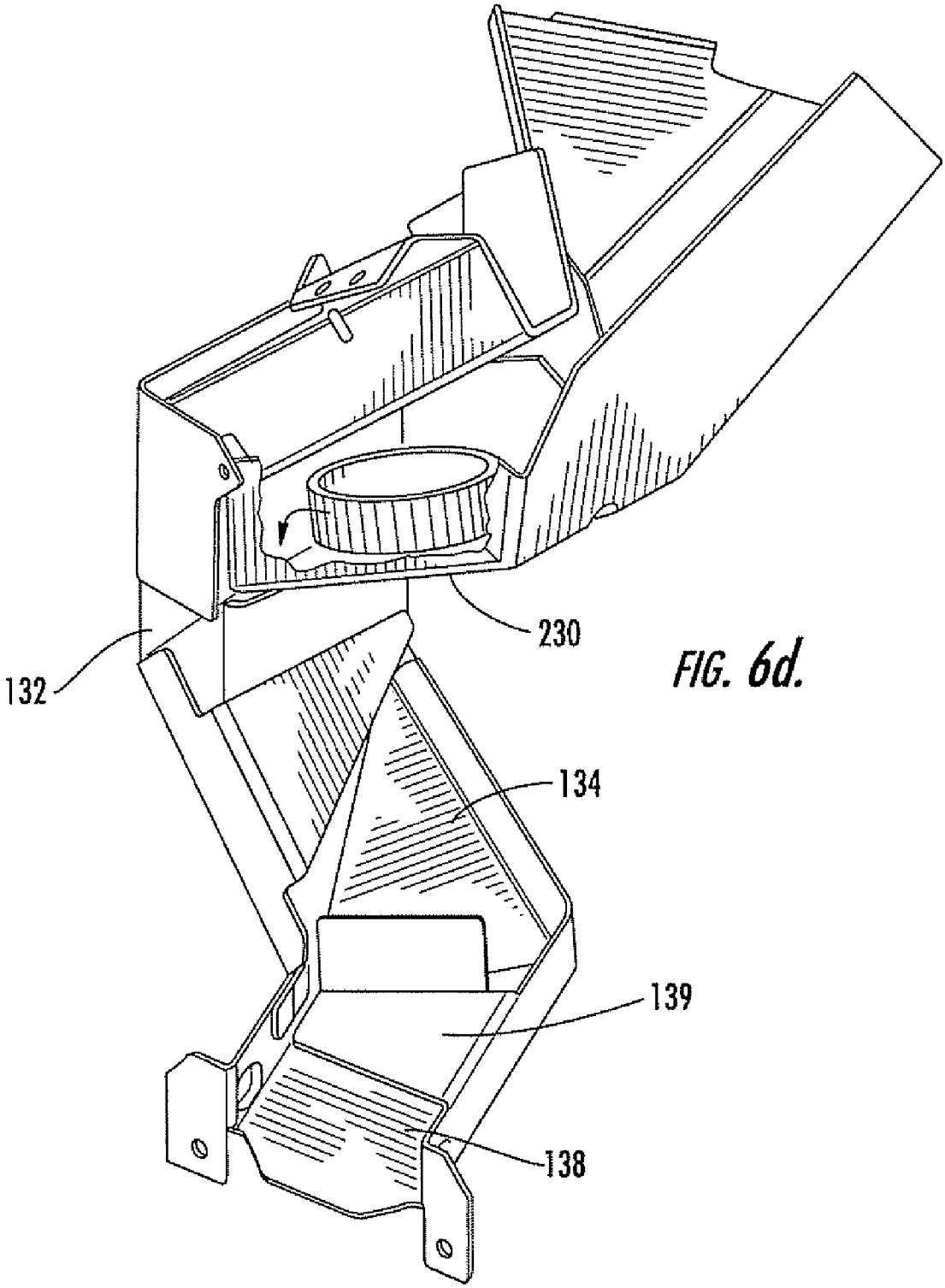
Figure 6E:
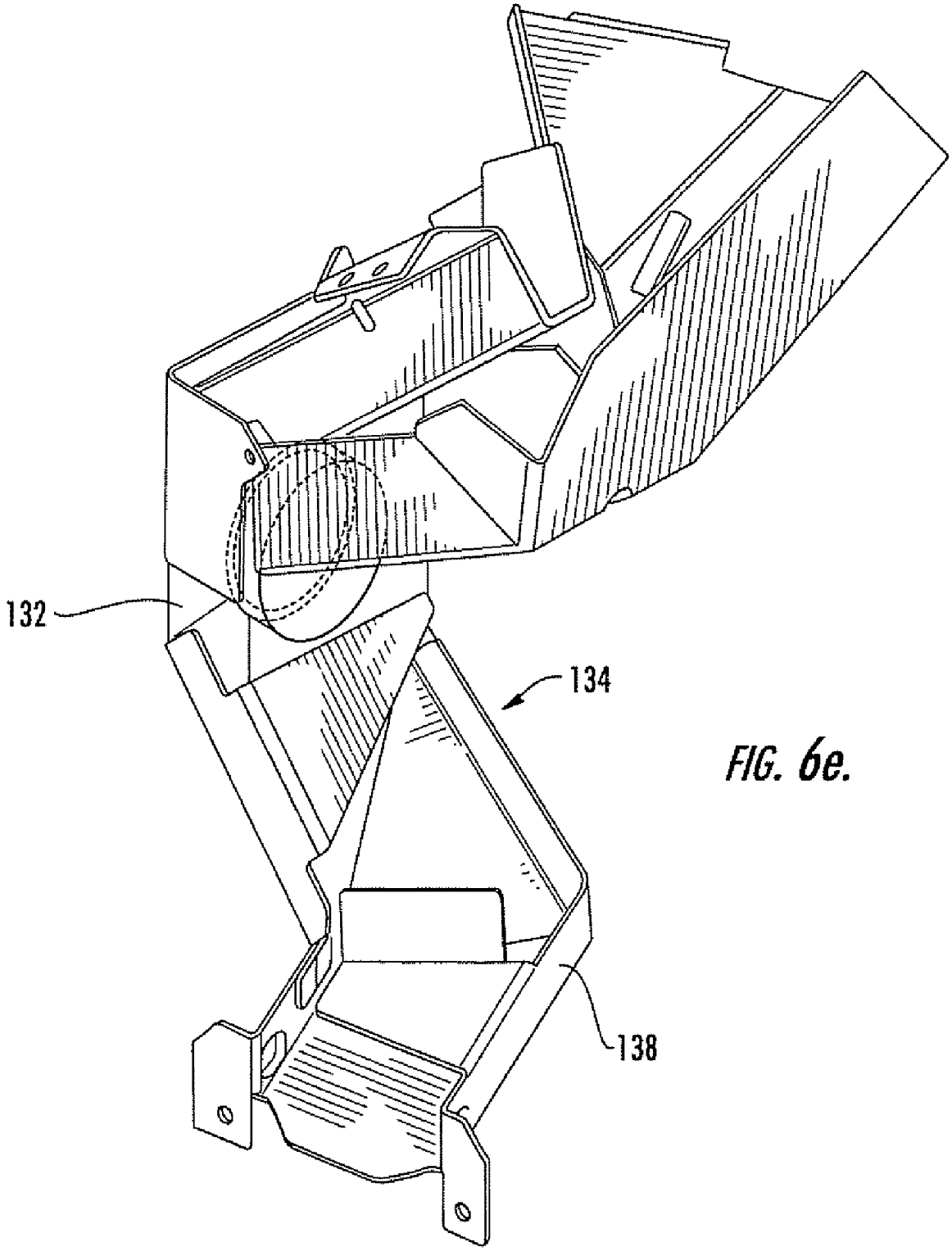
FIGS. 6*e*-6*g* are rear views of the lower chute of the closure dispenser of the system of FIG. 2 showing a cap traveling therethrough.
Figure 6F:
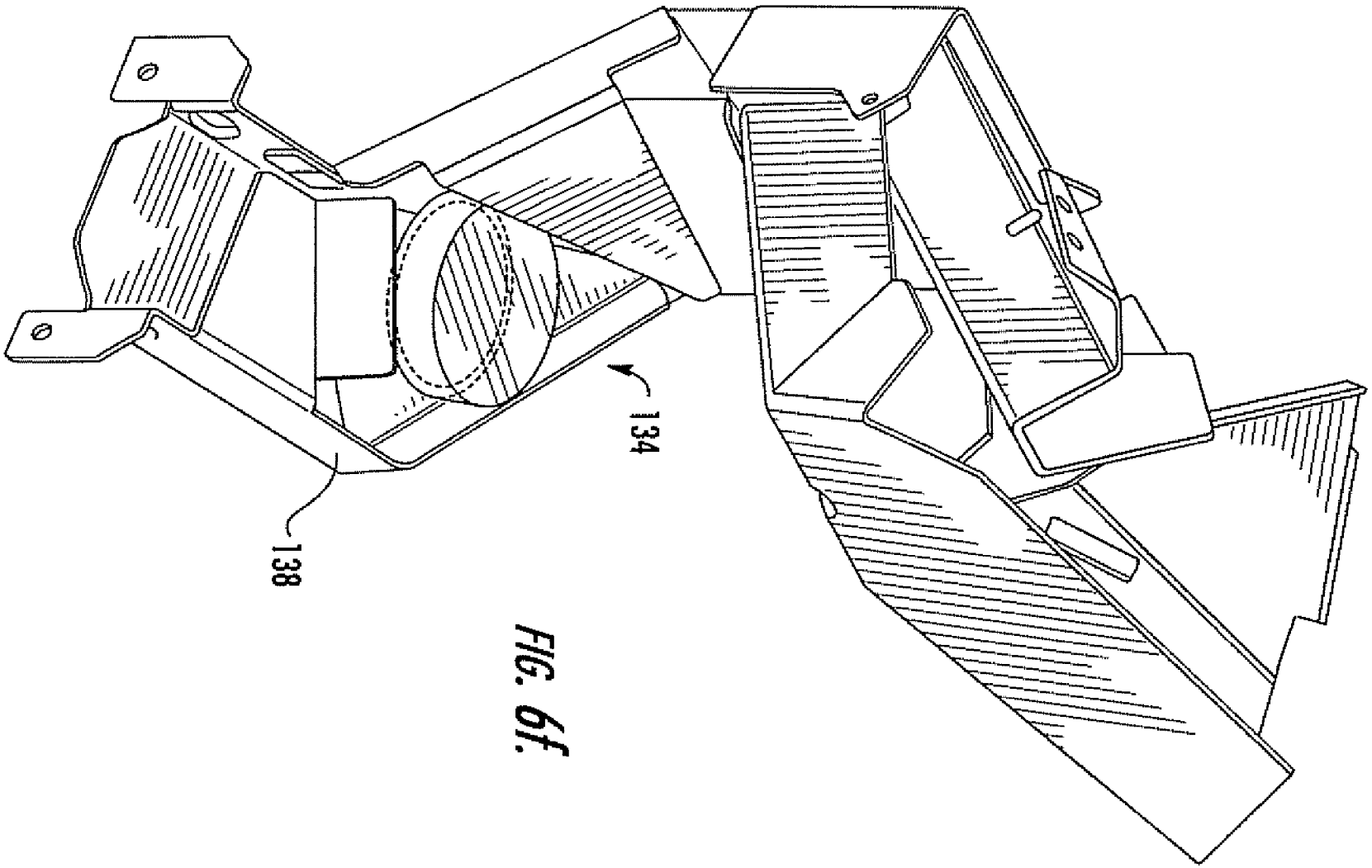
Figure 6G:
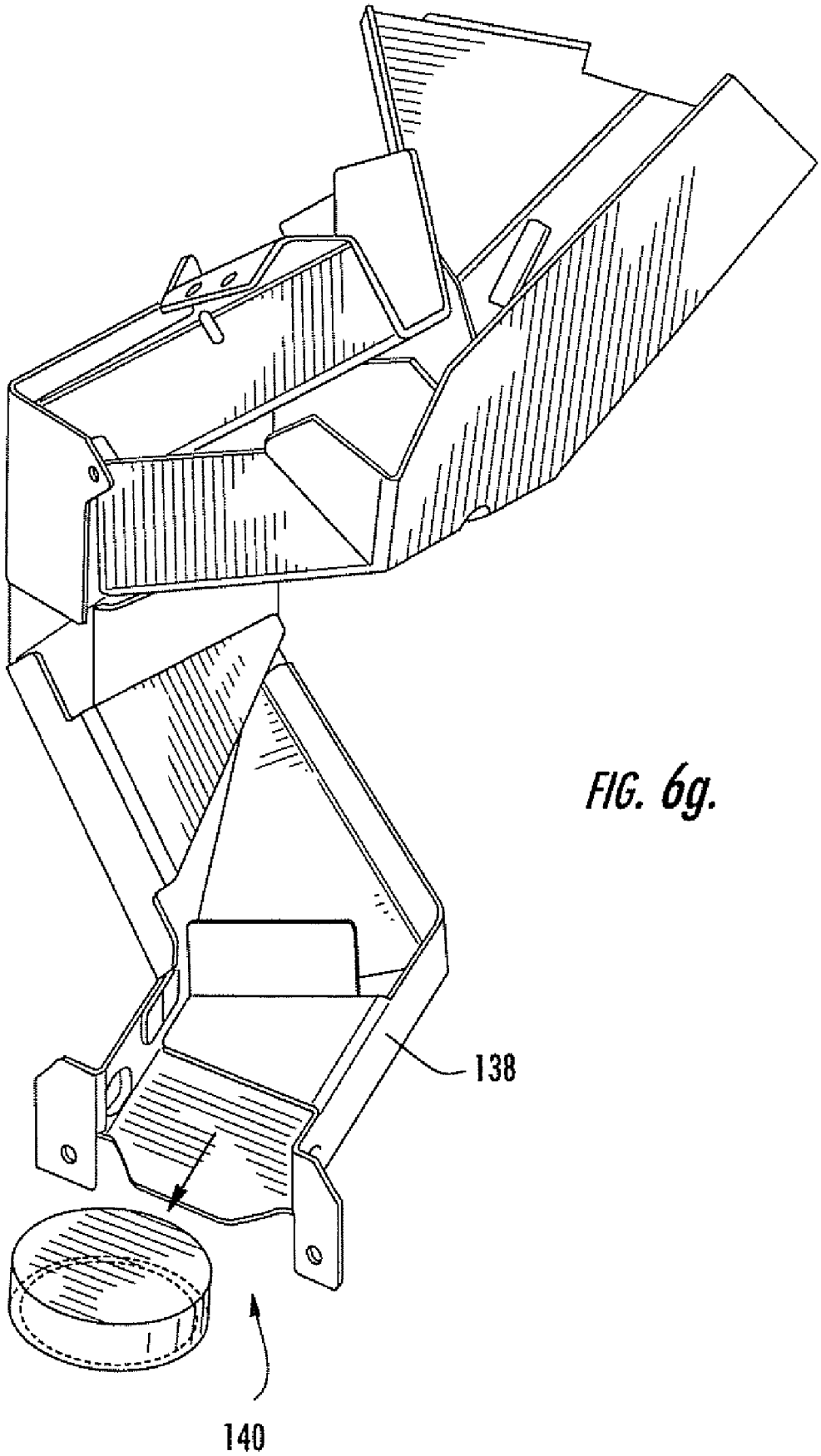
Figure 7:
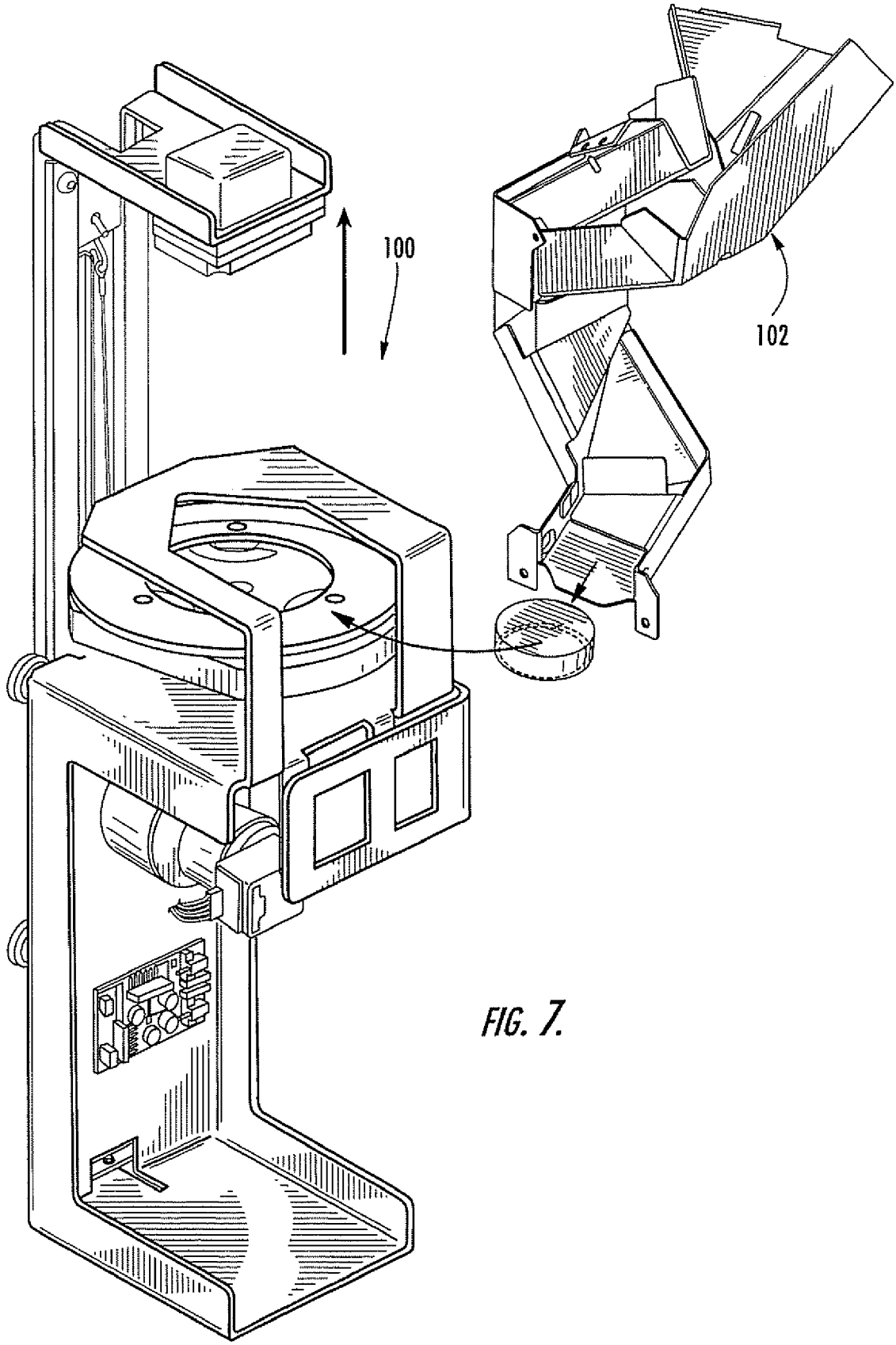
FIG. 7 is an exploded perspective view of the outlet channels of FIG. 5 showing the deposition of a cap therefrom onto a closure securing station.

Turning next to the dispensing of a cap from the closure dispenser 204 and referring to FIG. 4, as a cap exits the closure dispenser 204 through the outlet slot 210, the open end of the cap is facing the drum of the closure dispenser 204. As such, the cap exits the slot to be received "face-down" on the floor 222, with the edge of the cap contacting the bumper 221 (FIG. 6*a*). The cap slides down the floor 222 and over the edge shared by the floor 222 and the steep slide panel 223 into the trough 228. The cap has sufficient momentum that, once it reaches the bottom of the trough 228, it tips and lands "face-up" on the shallow panel 224 (FIG. 6*b*). The cap slides down the shallow panel 224 into the open channel 229 (FIGS. 6*c* and 6*d*). The cap slides on the floor 230 of the open channel 229 (maintaining its face-up orientation) until it reaches the lower chute 130. At this point the cap proceeds as described above with respect to the cap dispensed by the closure dispenser 104 (FIGS. 6*e*-6*g*).

The foregoing demonstrates that the system 40 can dispense caps of different sizes, depending on the size of the vial needed to hold the pharmaceutical tablets, to a single closure securing station. With only a single closure securing station needed for the system 40, space within the frame 44 can be saved. In addition, the closure dispensing station 102 can provide the closures from either of the closure dispensers 104, 204 to the closure securing station 100 in a predetermined orientation (in this instance, with the open end of the cap face down) to simplify the securing operation.

Those skilled in this art will appreciate that the closure dispensing system 102 can take other forms. For example, the closure dispensers 104, 204 may take a different configuration, and/or dispense caps from outlet slots or other apertures to different locations relative to the outlet channels 120, 220. Alternatively, the outlet channels 120, 220 and the lower chute 130 may take a different configuration, or follow a different path than that illustrated and described. Moreover, the dispensers 104, 204 may dispense the caps in a different orientation than that shown, particularly if the outlet channels 120, 220 and/or the lower chute 130 follow a different path, although in many embodiments it would be preferable to present the cap in a "face down" orientation as shown. In addition, other disk-shaped objects may also be dispensed with such a dispensing station.

Referring again to FIG. 4, in certain embodiments one or both of the closure dispensers 104, 204 includes a pre-staging area in which a next cap to be dispensed resides temporarily prior to dispensing. As an example, the pre-staging platform 112 of the closure dispenser 104 can serve to pre-stage caps as follows. As the drum of the closure dispenser 104 rotates to dispense a cap through the outlet slot 110, the dispensed cap drops through the outlet slot 110 onto the pre-staging platform 112. Continued rotation of the drum causes the cap to continue to move along the pre-staging platform 112 until the cap reaches a sensor 114. When the sensor 114 detects the presence of the cap, the sensor 114 signals the controller 42 to cease rotation of the drum. Thus, the cap is retained on the pre-staging platform 112 adjacent the sensor 114. When the controller 42 receives a signal that another cap is to be dispensed, the rotation of the drum forces the pre-staged cap past the sensor 114 and into the outlet channel 120. The drum continues to rotate until another cap is dispensed from the outlet slot 110 and conveyed to the sensor 114. Thus, in typical operation, a signal from the controller 42 (a) triggers conveyance of a pre-staged cap from the pre-staging platform 112 adjacent the sensor 114 to the outlet channel 120, and (b) triggers dispensing of a cap from the closure dispenser 104 to the pre-staging platform 112 adjacent the sensor.

A similar pre-staging operation occurs with the closure dispenser 204; pre-staged caps are dispensed from the pre-staging platform 212 to the outlet channel 220, and caps are dispensed from the outlet slot 210 to the pre-staging platform adjacent a sensor 214.

The pre-staging operations described above can facilitate dispensing of the caps by reducing the time between the receipt of a signal from the controller 42 and the arrival of a cap at the closure securing station 100. Because the caps are randomly distributed in the closure dispensers 104, 204, the time for a cap to be dispensed from the dispenser 104, 204 through its respective outlet slot 110, 210 is typically longer and much less predictable than the time for a cap to descend from the pre-staging platform 112, 212 adjacent a sensor through the respective outlet channel 120, 220 and the lower chute 130. As a result, the operations of the system 40 that precede capping (i.e., vial dispensing, vial labeling, and vial filling) are not held up by the dispensing of the correct cap for the filled vial. Accordingly, throughput of the system 40 can be increased.

Those skilled in this art will recognize that pre-staging may be achieved with pre-staging stations of different configurations (e.g., a flexible stopper to cease movement of the cap in the pre-stage position), and that in some embodiments pre-staging may be omitted entirely.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A dispenser for dispensing disk-shaped objects, the dispenser configured to dispense the objects one at a time through an outlet in a predetermined orientation, the dispenser including a stationary pre-staging station beneath the outlet, the pre-staging station configured to dispense an object to a desired location and to house a next object for subsequent dispensing, wherein the next object is separated from the remaining objects in the dispenser;

wherein the pre-staging station is positioned such that the dispensing of a further object from the dispenser causes the next object housed in the pre-staging station to be dispensed.

2. The dispenser defined in claim 1, wherein the pre-staging station comprises a platform below the outlet of the dispenser, the platform sized to retain the next object until subsequent dispensing.

3. The dispenser defined in claim 1, further comprising a sensor that detects the presence of the next object.

4. The dispenser defined in claim 3, wherein the sensor is adapted for connection to a controller that ceases operation of the dispenser responsive to the sensor.

5. The dispenser defined in claim 1, wherein the objects have one open end, and wherein the dispenser is configured to dispense the objects in the predetermined orientation in which the open end of the object faces in a first direction.

6. The dispenser defined in claim 1, wherein the objects are caps for pharmaceutical vials.

7. The dispenser defined in claim 1, wherein the dispenser includes a rotating drum that agitates the objects for dispensing.

8. The dispenser defined in claim 7, wherein the pre-staging station comprises a platform below the outlet of the dispenser, the platform sized to retain the next object until subsequent dispensing.

9. A dispenser for dispensing disk-shaped objects, the dispenser configured to dispense the objects one at a time through an outlet in a predetermined orientation, the dispenser including:

a pre-staging station beneath the outlet, the pre-staging station configured to dispense an object to a desired location and to house a next object for subsequent dispensing, wherein the next object is separated from the remaining objects in the dispenser; and a sensor adjacent the pre-staging station that detects the presence of the next object;

wherein the pre-staging station is positioned such that the dispensing of a further object from the dispenser causes the next object housed in the pre-staging station to be dispensed.

10. A dispenser for dispensing disk-shaped objects, the dispenser configured to dispense the objects one at a time through an outlet in a predetermined orientation, the dispenser including:

a rotating drum that agitates and singulates the objects for dispensing; and a pre-staging station beneath the outlet, the pre-staging station configured to dispense an object to a desired location and to house a next object for subsequent dispensing, wherein the next object is separated from the remaining objects in the dispenser;

wherein the pre-staging station is positioned such that the dispensing of a further object from the dispenser causes the next object housed in the pre-staging station to be dispensed.

11. A dispenser for dispensing disk-shaped objects, the dispenser configured to dispense the objects one at a time through an outlet in a predetermined orientation, the dispenser including a stationary pre-staging station beneath the outlet, the pre-staging station configured to dispense an object to a desired location and to house a next object for subsequent dispensing, wherein the next object is separated from the remaining objects in the dispenser;

wherein the pre-staging station is positioned such that movement of the dispenser causes: (a) a further object to be housed in the pre-staging station and (b) the next object to be dispensed to the desired location.

* * * * *

UNITED STATES PATENT AND TRADEMARK OFFICE

CERTIFICATE OF CORRECTION

PATENT NO. : 8,056,760 B2
APPLICATION NO. : 11/738664
DATED : November 15, 2011
INVENTOR(S) : Moran, Jr. et al.

It is certified that error appears in the above-identified patent and that said Letters Patent is hereby corrected as shown below:

Column 3, Line 26: correct ""lower", "lower"" to read -- "lower", "over" --

Signed and Sealed this
Twenty-first Day of February, 2012

David J. Kappos

David J. Kappos
*Director of the United States Patent and Trademark Office*